US005775933A

United States Patent [19]

Chen

[11] Patent Number: 5,775,933

[45] Date of Patent: Jul. 7, 1998

[54] STRUCTURE OF LAMP SOCKET

[76] Inventor: Ming-Hsiung Chen, 7F, 16, Alley 3, Lane 227, Nung-An St., Taipei, Taiwan

[21] Appl. No.: 678,554

[22] Filed: Jul. 8, 1996

[51] Int. Cl.[6] ..... H01R 4/24

[52] U.S. Cl. ..... 439/419

[58] Field of Search ..... 439/419, 414, 439/280, 356, 417, 611, 612, 613, 615

[56] References Cited

U.S. PATENT DOCUMENTS

| | | | |
|---|---|---|---|
| 2,800,635 | 3/1957 | Christenbery | 439/419 |
| 3,716,818 | 2/1973 | Finkelstein | 439/419 |
| 5,051,877 | 9/1991 | Liao | 439/419 |
| 5,109,324 | 4/1992 | Ahroni | 439/419 |
| 5,228,774 | 7/1993 | Liao | 439/419 |
| 5,339,232 | 8/1994 | Lin | 439/419 |
| 5,643,006 | 7/1997 | Wang et al. | 439/419 |
| 5,660,560 | 8/1997 | Cheng et al. | 439/419 |

*Primary Examiner*—Gary F. Paumen
*Assistant Examiner*—Tho Dac Ta
*Attorney, Agent, or Firm*—Ladas & Parry

[57] ABSTRACT

An electric socket in which the socket body has two outer electric wire supports transversely raised from the two opposite ends of the top wire groove thereof, and an intermediate electric wire support transversely raised from the top wire groove between the positive metal contact plate and the negative metal contact plate, the outer electric wire supports and the intermediate electric wire support having a respective transversely corrugated top edge fitting the transverse cross section of the periphery of the electric wire being mounted in the top wire groove and forced into engagement the periphery of the electric wire to stop rain water from causing an electric short circuit or current leakage.

1 Claim, 4 Drawing Sheets

STRUCTURE OF LAMP SOCKET

BACKGROUND OF THE INVENTION

The present invention relates to lamp sockets for Christmas tree light sets, and relates more particularly to an improved structure of lamp socket which effectively prohibits rain water from passing to the inside of the top wire groove of the socket body to short circuit the positive and negative metal contact plates.

FIGS. 5 and 6 show a regular lamp socket for Christmas tree light sets. This structure of lamp socket comprises a socket body 1' having a center metal contact plate 3' and a side metal contact plate 4' on the inside, an electric wire 5' mounted in the grooved top side of the socket body 1', and a socket cap 2' fastened to the socket body 1' to hold down the electric wire 5', causing the center metal contact plate and the side metal contact plate to make contact with a respective conductor of the electric wire 5'. This structure of lamp socket is not suitable for use outdoors during a raining day. Because there is a longitudinal rain water accumulation space 51' defined in the grooved top side of the socket body 1' beneath the electric wire 5' when the lamp socket is assembled. When the lamp socket is used outdoors during a raining day, rain water tends to pass to the grooved top side of the socket body and to be accumulated in the rain water accumulation space 51', thereby causing the center metal contact plate and the side metal contact plate to be short-circuited. Various lamp sockets have been disclosed and designed to prevent an electric shock. Exemplars of these are seen in U.S. Pat. Nos. 2,800,635; 3,130,921; 5,051,877; 5,109,324; 5,389,008;5,474,467.

SUMMARY OF THE INVENTION

The present invention has been accomplished to provide a lamp socket which effectively prohibits rain water from passing to the top wire groove of the socket body, and prevents a short circuit between the center metal contact plate and the side metal contact plate. According to the present invention, the electric socket comprises a socket body having a top wire groove and holding a center metal contact plate and a side metal contact plate, an electric wire mounted in the top wire groove of the socket body, and socket cap fastened to the socket body to force the conductors of the electric wire into contact with the center metal contact plate and the side metal contact plate respectively, wherein two outer electric wire supports are transversely raised from two opposite ends of the top wire groove of the socket body, and an intermediate electric wire support is transversely raised from the top wire groove of the socket body between the center metal contact plate and the side metal contact plate. The outer electric wire supports and the intermediate electric wire support have a respective transversely corrugated top edge fitting the transverse cross section of the periphery of the electric wire and forced into engagement the periphery of the electric wire to stop rain water from causing an electric short circuit or current leakage.

DETAILED DESCRIPTION OF THE PREFERRED EMBODIMENT

Figure 1:
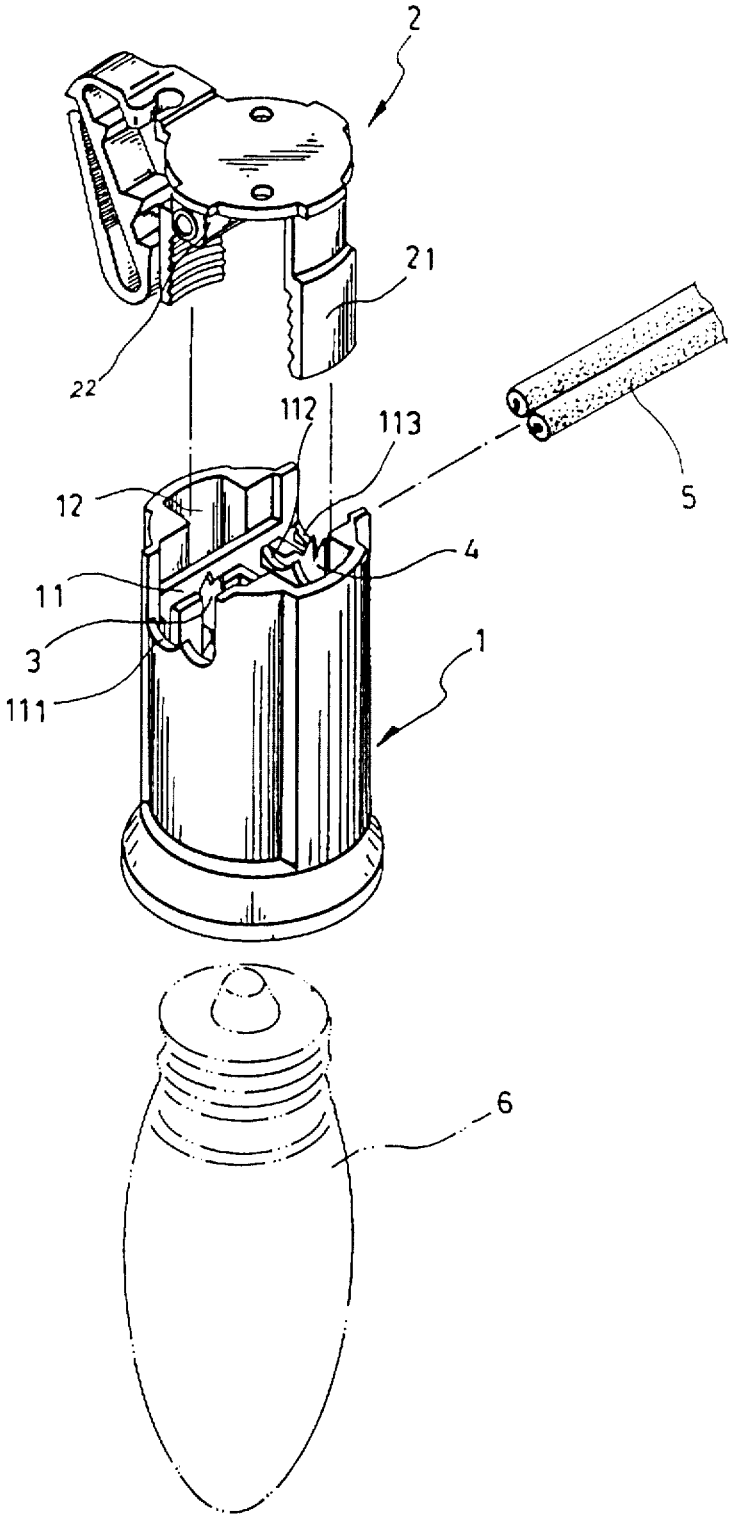
FIG. 1 is an exploded view of a lamp socket according to the present invention.

Referring to FIG. 1, a lamp socket in accordance with the present invention is generally comprised of a socket body 1 adapted for receiving a bulb 6, and socket cap 2. The socket body 1 comprises a wire groove 11 at the top adapted for receiving an electric wire 5, two plugs holes 12 disposed at two opposite sides of the wire groove 11, two outer electric wire supports 111 and 113 transversely raised from the two opposite ends of the wire groove 11, and an intermediate electric wire support 112 transversely raised from the wire groove 11 between the outer electric wire supports 111 and 113. Each of the electric wire supports 111, 112, and 113 has a transversely corrugated top edge fitting the cross section of the periphery of the electric wire 5. A center (positive) metal contact plate 3 and a side (negative) metal contact plate 4 are respectively mounted in the socket body 1, having a respective pointed top end projecting into the wire groove 11 for making contact with a respective conductor of the electric wire 5. When the center metal contact plate 3 and the side metal contact plate 4 are installed in the socket body 1, they are respectively disposed at two opposite sides of the intermediate electric wire support 112 between the outer electric wire supports 111 and 113. The socket cap 2 comprises two downward mounting plug rods 21 adapted for fastening to the plug holes 12 of the socket body 1, and a pressure block 22 raised from the bottom between the downward mounting plug rods 21 and adapted for pressing on the electric wire 5.

Figure 2:
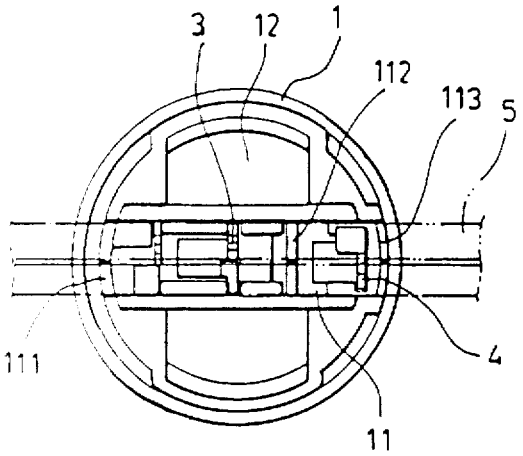
FIG. 2 is a top plain view of the lamp socket shown in FIG. 1, showing the electric wire supported on the electric wire supports and disposed in contact with the center metal contact plate and the side metal contact plate.
Figure 3:
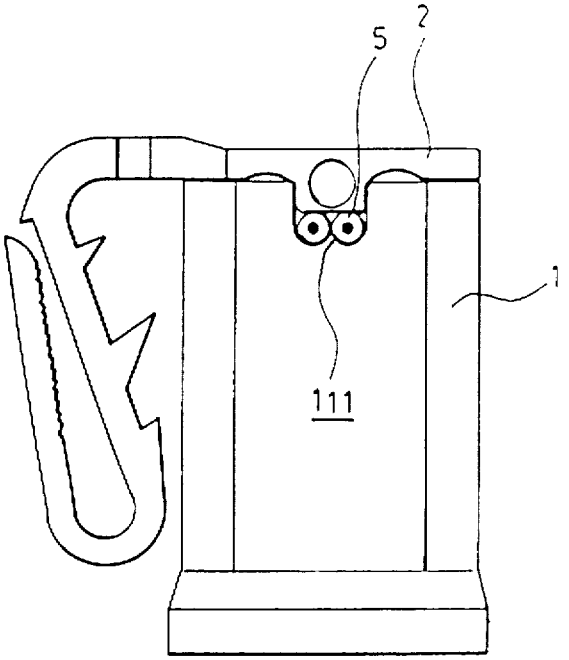
FIG. 3 is a side plain view of the lamp socket shown in FIG. 1, showing the electric wire retained between the electric wire supports of the socket body and the socket cap.
Figure 4:
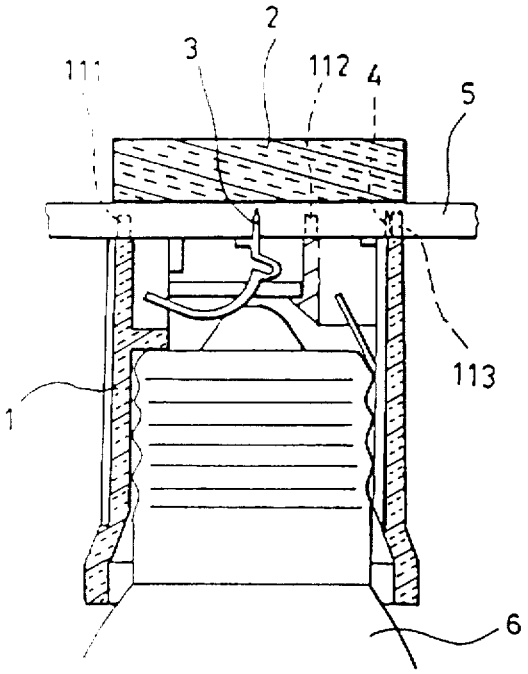
FIG. 4 is a sectional view of the lamp socket shown in FIG. 1, showing the electric wire supports forced into engagement with the transversely curved bottom side of the electric wire.
Figure 5:
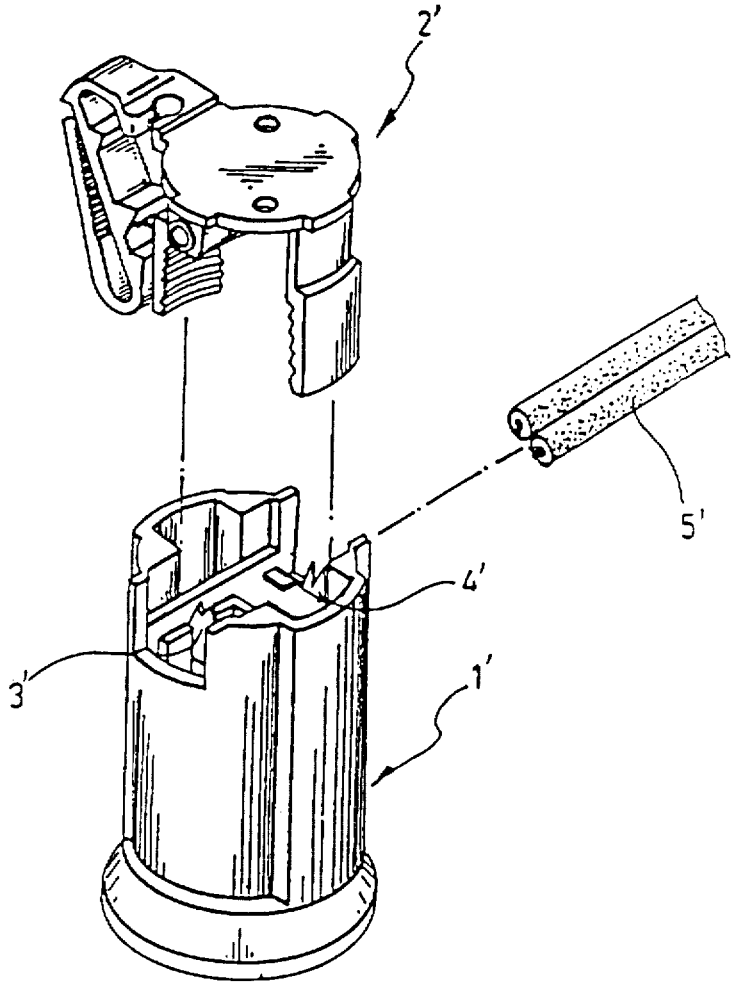
FIG. 5 PRIOR ART
FIG. 5 is an exploded view of a lamp socket according to the prior art.
Figure 6:
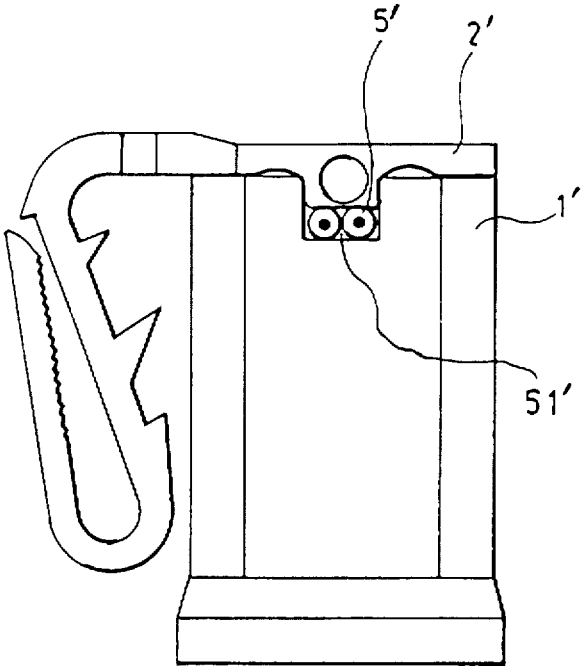
FIG. 6 PRIOR ART
FIG. 6 is a side plain view of a lamp socket shown in FIG. 5, showing a longitudinal rain water accumulation space defined beneath the electric wire.

Referring to FIGS. 2, 3, and 4, when the electric wire 5 is mounted in the wire groove 11 of the socket body 1, the socket cap 2 is fastened to the socket body 1 by fastening the downward mounting plug rods 21 of the socket cap 2 to the plug holes 12 of the socket body 1 respectively. When installed, center metal contact plate 3 and the side metal contact plate 4 are forced into contact with a respective conductor of the electric wire 5, and the corrugated top edges of the electric wire supports 111, 112 and 113 are forced into engagement with the transversely curved bottom side of the electric wire 5. When the bulb 6 is threaded into the socket body 1, the tip contact and ring contact are respectively forced into contact with the center metal contact plate 3 and the side metal contact plate 4, and therefore the bulb 6 and the electric wire 5 are electrically connected. Because the outer electric wire supports 111 and 113 are transversely raised from the two opposite ends of the wire groove 11 and forced into engagement with the transversely curved bottom side of the electric wire 5 after the installation of the socket cap 2, rain water is prohibited from causing an electric current leakage through the bottom side of the electric wire 5. Because the intermediate electric wire support 112 is transversely raised from the wire groove 11 and forced into engagement with the transversely curved bottom side of the electric wire 5 at a location between the center metal contact plate 3 and the side metal contact plate 4, no electric short circuit will be caused to happen between the contact points between the electric wire 5 and the metal contact plates 3 and 4.

It is to be understood that the drawings are designed for purposes of illustration only, and are not intended as a definition of the limits and scope of the invention disclosed.

What the invention claimed is:

1. An electric socket of the type comprising a socket body having a top wire groove and two plug holes at two opposite sides of the top wire groove, a center metal contact plate and a side metal contact plate respectively mounted in said socket body and partially projecting into said top wire groove of said socket body, an electric wire mounted in said top wire groove of said socket body, and a socket cap having two downward mounting plug rods respectively fastened to said plug holes of said socket body to hold down said electric wire, the improvement comprising two outer electric wire supports transversely raised from two opposite ends of the top wire groove of said socket body, and an intermediate electric wire support transversely raised from the top wire groove of said socket body between said center metal contact plate and said side metal contact plate, said outer electric wire supports and said intermediate electric wire support having a respective transversely corrugated top edge fitting the transverse cross section of the periphery of said electric wire and forced into engagement the periphery of said electric wire after the mounting of said socket cap on said socket body.

* * * * *